United States Patent [19]

Kim

[11] Patent Number: 4,635,793

[45] Date of Patent: Jan. 13, 1987

[54] GOLF BAG

[75] Inventor: Tae G. Kim, Seoul, Rep. of Korea

[73] Assignee: Byung D. Yim, Rochester, N.Y.

[21] Appl. No.: 593,065

[22] Filed: Mar. 26, 1984

[30] Foreign Application Priority Data

Apr. 14, 1983 [KR] Rep. of Korea ..... 3310

[51] Int. Cl.[4] ..... A63B 55/00

[52] U.S. Cl. ..... 206/315.6; 206/315.7

[58] Field of Search ..... 206/315.2–315.8; 211/60 G, 70.2; 248/96

[56] References Cited

U.S. PATENT DOCUMENTS

| | | | |
|---|---|---|---|
| 1,741,057 | 12/1929 | Howe | 206/315.8 |
| 1,826,216 | 10/1931 | Johnson | 206/315.6 |
| 1,956,008 | 4/1934 | Deibel | 206/315.6 |
| 2,866,490 | 12/1958 | Thompson | 206/315.4 |
| 3,435,866 | 4/1969 | Cantwell | 206/315.6 |
| 3,674,072 | 7/1972 | Shuto | 206/315.6 |
| 4,130,153 | 12/1978 | Zopf | 206/315.6 |
| 4,155,387 | 5/1979 | Costa | 206/315.6 |

FOREIGN PATENT DOCUMENTS

| | | | |
|---|---|---|---|
| 107030 | 3/1939 | Australia | 248/96 |
| 45-15546 | 6/1970 | Japan . | |
| 8333 | of 1911 | United Kingdom | 206/315.5 |
| 207317 | 11/1923 | United Kingdom | 206/315.5 |

*Primary Examiner*—William Price
*Assistant Examiner*—Sue A. Weaver
*Attorney, Agent, or Firm*—Martin LuKacher

[57] ABSTRACT

A collapsible golf bag having a removable tube (1) which screws into a base seat (2) and holds up and taut a frame and tubular body assembly (4) connected to the top of the bag (5). The frame bears upon a key (3) which protrudes from the tube and can be pressed into the tube to release the tube from the frame and allow the bag to be collapsed.

13 Claims, 3 Drawing Figures

GOLF BAG

DESCRIPTION

The present invention relates to golf bags and particularly to collapsible golf bags which can be collapsed for storage or shipment and extended and set up for use.

The invention is especially suitable for providing a collapsible golf bag having compartments in which the golf clubs can be placed in accordance with their classification.

Conventional golf bags are large and bulky. It is therefore difficult and expensive to ship or transport the bags. In addition, the classification of the golf clubs placed in the bag so as to facilitate the order of their use while playing golf is difficult.

It is the principal object of the present invention to obviate the above disadvantages by providing an improved golf bag which is collapsible for shipment and which, when set up for use, can receive golf clubs in accordance with their classification.

It is another object of the present invention to provide an improved collapsible golf bag which is easy to set up and may easily be collapsed so as to reduce the bulk of the bag.

It is a further object of the present invention to provide an improved collapsible golf bag having a frame assembly which enables the bag to be selectively set up and collapsed, which frame assembly also provides compartments for receiving golf clubs in accordance with their classification.

The foregoing and other objects, features and advantages of the invention as well as a presently preferred embodiment thereof will become more apparent from a reading of the following description in connection with the accompanying drawings in which.

Figure 1:
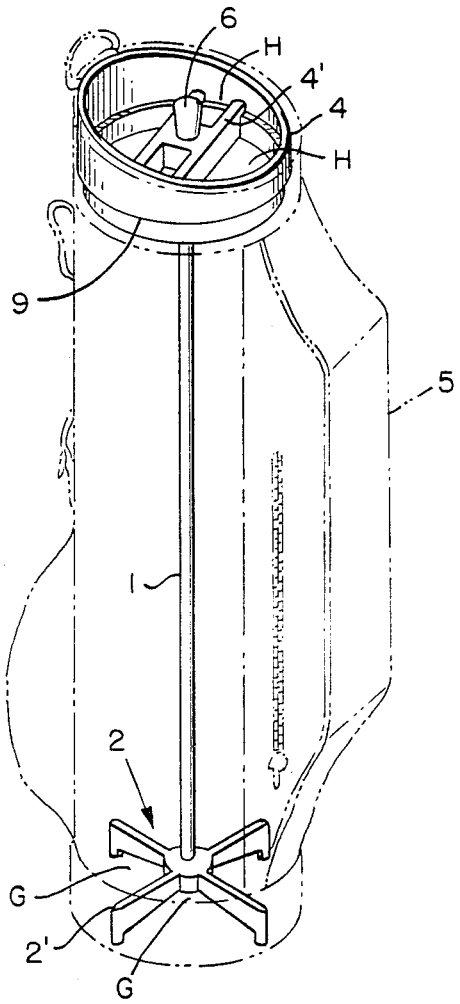
FIG. 1 is a perspective view of a collapsible golf bag embodying the invention.
Figure 2:
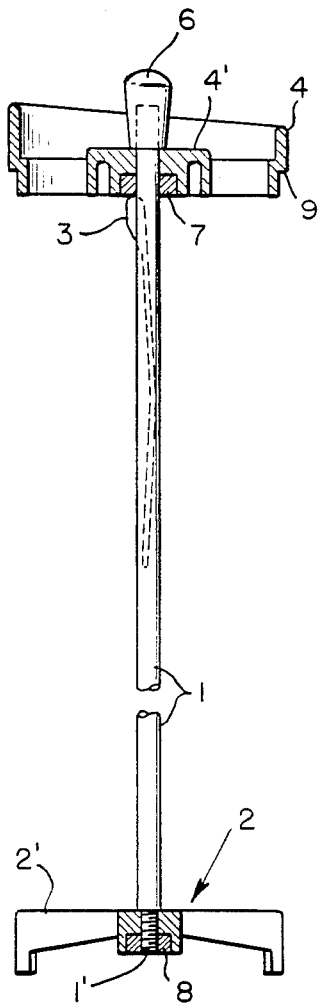
FIG. 2 is a sectional view of the frame assembly of the golf bag shown in FIG. 1.
Figure 3:
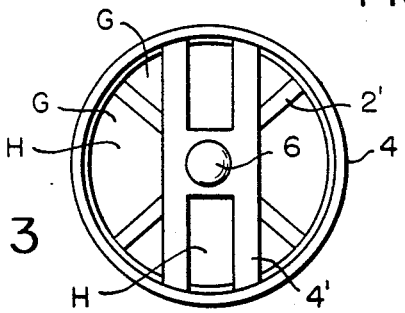
FIG. 3 is a plan view of the frame assembly shown in FIG. 2.

Referring to the drawings, there is shown in FIG. 1, a golf bag 5 in set up condition. The bottom of the bag receives a base or seat 2 having a hub and legs 2' extending radially thereof. The legs define lower compartments G for receiving the golf clubs. The hub has an opening therethrough. A steel nut 8 is disposed in the opening and has internal threads. The opening is disposed along the center of the bag and is axially aligned therewith.

A tubular body 4 is disposed in the upper end of the bag 5. This tubular body has a shoulder 9 on the lower edge of its outer circumference so as to enable the tubular body to be inserted and fixed to the upper portion of the golf bag 5, as by sewing. A member 4' extends diagonally across the tubular body. This member is in the shape of an "H". It reinforces the tubular body 4 and defines upper compartments H for receiving the golf clubs. The cross leg in the center of the member 4' has an opening therethrough. A steel washer 7 is disposed in a recessed notch in the opening and defines a portion of the lower surface of the member 4'. The opening through the member 4' is disposed centrally along the axis of the bag and is in alignment with the opening in the base 2.

The frame assembly is completed by a rod 1 in the form of a tube. This tube has a bolt portion 1' at its lower end which has external threads. The tube also has a key 3 which extends outwardly therefrom. The key includes an extension which holds the key and allows it to be depressed into the tube. The upper or top end of the tube 1 has a cap 6 thereon.

In order to set up the bag, the tube 1 is inserted through the opening in the member 4' until the protruding key 3 (which is depressed in the process of insertion through the opening), engages the bottom surface of the steel washer portion of the member 4'. The bolt portion 1' is then screwed into the opening in the base. The number of turns, and therefore the distance the central tube is screwed into the base, is adjustable so as to insure that the tubular body 4 extends the bag 5 so that it becomes taut and will maintain its shape.

When the golf clubs are placed in the bag, they are received into the compartments H in groups in accordance with their classification. The handle portions of the golf clubs are inserted to the compartments H and passed through the bag into the compartments G. A number of golf clubs therefore may be received in the bag without inclining on one side and the handles of the golf clubs do not become entangled with each other. The golf clubs may be freely inserted into the bag or lifted out of the bag.

In order to collapse the bag, the key is depressed and the bolt portion 1' is unscrewed from the base. The central tube 1 is then removed.

It will be apparent that the invention provides a collapsible golf bag that is convenient in use and allows the classified receiving of golf clubs. It is collapsible so as to enable the efficient, economical transportation and shipment of the bag in disassembled condition because the bulk of the bag is then minimized.

I claim:

1. A collapsible golf bag having a frame for holding the bag taut which comprises a base disposed in the lower end of the bag, a tubular body disposed in the upper end of the bag, a member extending across the tubular body and connected thereto, said member dividing the bag into golf club receiving compartments, said member having a hole extending in a direction axially of said bag, an opening in said base aligned with said hole, a rigid rod extending through said hole into said base opening, a key protruding laterally from said rod and engageable with the surface of said member facing said base for maintaining said bag upright and taut, and said key being movably disposed in said rod to release said rod from said frame to enable said rod to be removed from said bag and said bag to be collapsed.

2. The collapsible bag according to claim 1 wherein said rod is a tube, said key having an extension disposed in said tube and extending axially thereof, said key normally extending out of said tube and being movable into said tube when depressed.

3. The collapsible bag according to claim 2 wherein said extension provides means yieldably biasing said key outwardly from said tube.

4. The collapsible bag according to claim 1 wherein said rod has means on the end thereof opposite from the end received in said base opening engageable with the surface of said member opposite to said surface thereof which faces said base.

5. The collapsible golf bag according to claim 4 wherein said means is a cap on said opposite end of said rod.

6. The collapsible golf bag according to claim 1 wherein said opening, said hole and said rod are disposed centrally of said bag.

7. The collapsible golf bag according to claim 1 wherein said opening in said base has an internal thread and said end of said rod has an external thread, said threads being engageable with each other over an adjustable length to adjust the length of said bag and maintain it taut when set up.

8. The collapsible golf bag according to claim 1 wherein said base is separate from said bag.

9. The collapsible golf bag according to claim 1 wherein said base has a central hub and a plurality of legs extending radially thereof to define a plurality of golf club receiving compartments in said base.

10. The collapsible golf bag according to claim 1 wherein said member is a frame extending diagonally across said tubular body, said frame being of a shape defining an H with side legs extending across said body and with the center leg thereof having said hole therethrough.

11. The collapsible golf bag according to claim 10 further comprising a metal washer disposed in said center leg and having a hole aligned with said hole in said center leg and a surface on one side thereof which provides said surface of said member engageable with said key.

12. The collapsible golf bag according to claim 8 wherein said base has a hub portion, a nut disposed in said hub portion which provides said internal threads of said opening.

13. A collapsible golf bag having a frame for holding the bag taut which comprises a base disposed in the lower end of the bag and having threaded means, a tubular body disposed in the upper end of the bag, a member extending across the tubular body and connected thereto, said member dividing the bag into golf club receiving compartments, said member having a hole extending in a direction axially of said bag, a rigid rod extending through said hole and having threaded means cooperating with said base threaded means, a key protruding laterally from said rod and engageable with the surface of said member facing said base for maintaining said bag upright and taut, and said key being movably disposed in said rod to release said rod from said frame to enable said rod to be removed from said bag and said bag to be collapsed.

* * * * *